United States Patent [19]

Stewart, Jr. et al.

[11] Patent Number: 4,907,415

[45] Date of Patent: Mar. 13, 1990

[54] SLUSH ICE MAKING SYSTEM AND METHODS

[75] Inventors: William E. Stewart, Jr., Olathe, Kans.; Michael E. Greer, Gladstone, Mo.; Carol L. G. Dona, Overland Park, Kans.

[73] Assignee: The Curator of the University of Missouri, Columbia, Mo.

[21] Appl. No.: 276,137

[22] Filed: Nov. 23, 1988

[51] Int. Cl.[4] ..... F25C 1/12

[52] U.S. Cl. ..... 62/66; 62/330; 62/347

[58] Field of Search ..... 62/59, 330, 347, 66, 62/340; 165/133

[56] References Cited

U.S. PATENT DOCUMENTS

| | | | |
|---|---|---|---|
| 2,161,953 | 12/1937 | Oman | 62/59 X |
| 3,314,473 | 4/1967 | Smith et al. | 165/30 |
| 3,423,952 | 1/1969 | Pugh | 62/347 X |
| 4,249,388 | 2/1981 | Burne | 62/330 X |
| 4,625,525 | 12/1986 | Bradbury et al. | 62/330 |

*Primary Examiner*—William E. Tapoical

*Attorney, Agent, or Firm*—James B. Hinson

[57] ABSTRACT

The invention provides apparatus and a method for making slush ice. A liquid is directed to flow over a hot exchanger to cool the liquid and form slush. By selecting the constituents of the liquid such that the adhesion and cohesion forces are controlled to permit harvesting the slush while substantially all of the energy required by conventional harvesting cycles is saved.

10 Claims, 3 Drawing Sheets

Fig. 3
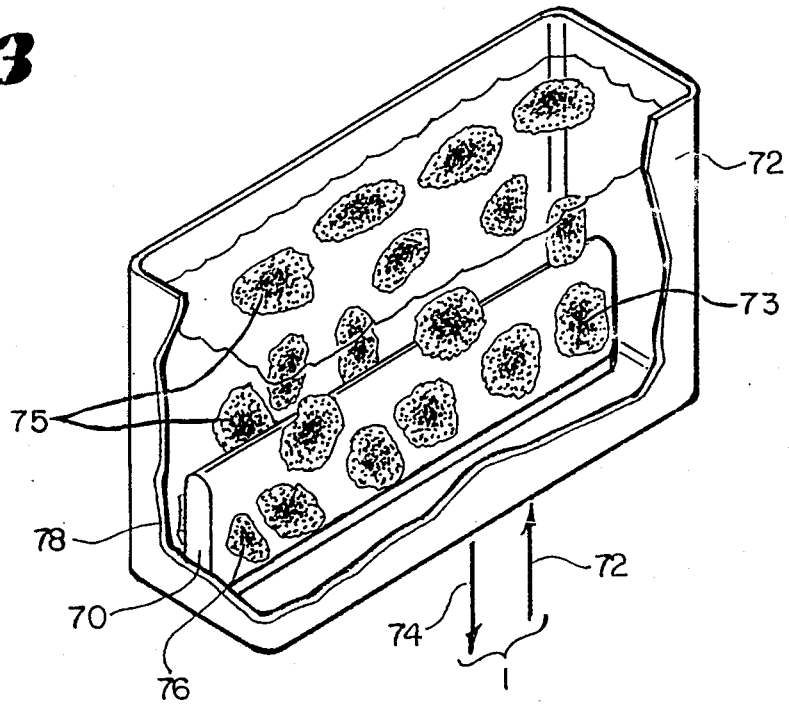
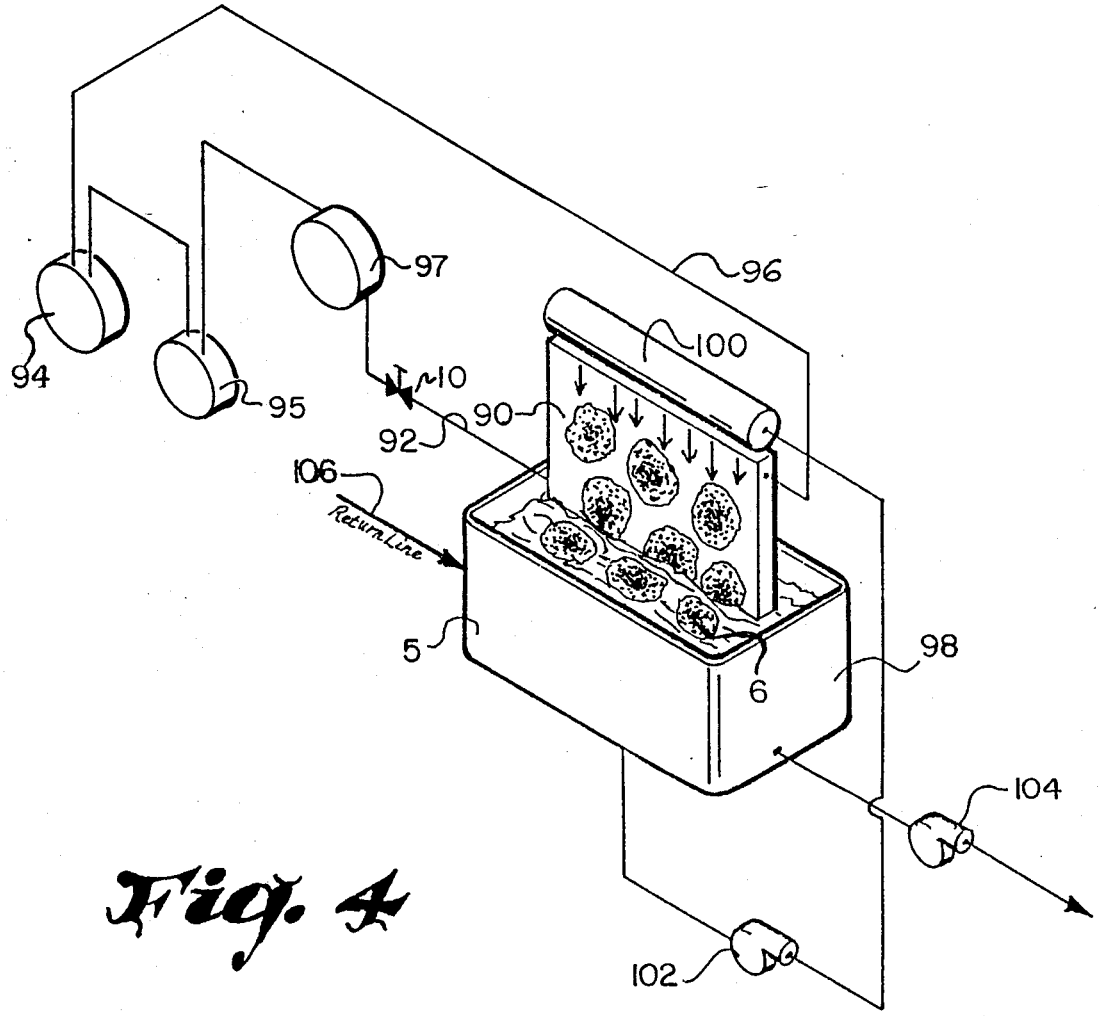
Fig. 4

SLUSH ICE MAKING SYSTEM AND METHODS

BACKGROUND OF THE INVENTION

Thermal storage is a concept generating wide interest as a method of electrical utility load management. From the prospective of the utility, load management offers an opportunity to increase return on investment by reducing the amount of installed generating capacity. Thermal storage is an attractive method of decreasing the peak loading due to air conditioning intermittent loads.

Several methods are currently being used for sensible and latent cool thermal storage. Dynamic ice harvesters are one technique for latent heat storage using ice. In typical ice harvesting systems, ice is formed on the exterior surface of a heat transfer surface and periodically removed by means of a defrost harvesting cycle, which melts a thin layer of ice adjacent to the heat transfer surface. Overall efficiency of the system is adversely effected by the defrost harvesting cycle, which may utilize up to about 20% of the energy input to the system. Alternatively, mechanical harvesting techniques, also requiring additional energy, may be used.

SUMMARY OF THE INVENTION

The apparatus and methods for thermal energy storage provided by the current invention save substantially all of the energy utilized in the harvesting portion of prior art ice making processes. In practicing the present invention, a mass ("slush") utilized to store heat is formed as a mixture of solids and a water based liquid on the surface of a heat exchanger. The solids are formed by cooling the water based liquid, which consists of a mixture of water and electrolytes or non-electrolytes, positioned in a heat exchange relationship with the heat exchanger. As the solids form, portions of the water based liquid are trapped therein to form "slush" which accumulates on the heat exchanger. This "slush" is harvested (removed from the surface of the heat exchanger) and mixed with an additional quantity of the water based liquid or with previously harvested "slush."

Each interval of time, beginning when a particular accumulation of "slush" begins and extending to the point in time at which at least a portion of the accumulated "slush" releases from the heat exchanger and mixes with a larger quantity of the liquid or with previously harvested "slush," is defined as a "cycle." The invention provides apparatus and methods for making "slush" using a "self release" or a "no penalty" harvesting technique, as further described below. Each of these harvesting techniques saves substantially all of the energy dissipated by the harvesting portion of prior art ice making processes.

More specifically, the preferred embodiment of the invention comprises apparatus operable to implement a "slush" ice making cycle using a "self release" harvesting technique. The apparatus includes a heat exchange surface in heat exchange relationship with a water based liquid. As the liquid is cooled a soft mass ("slush") consisting of a mixture of solids (ice crystals) and the liquid is formed on a downwardly extending surface of a heat exchanger. Electrolytes and/or non-electrolytes in the water based liquid cause the "slush" to accumulate as a soft (as compared to frozen substantially pure water) mixture of ice crystals and the water based liquid. This "slush" accumulates until it attains sufficient size that the force of gravity and interactions with the water based liquid are sufficient to cause at least a portion of the accumulated "slush" to release from the surface of the heat exchanger. As the "slush" releases, it mixes with a larger quantity of the water based liquid or with previously harvested "slush" and frequently breaks into smaller pieces.

The surfaces of the heat exchanger are selected to further reduce the adhesion between the accumulated "slush" and the heat exchanger. Surfaces believed to be most advantageous for use as heat exchanger surfaces are those having simple geometrical shapes, i.e. those substantially free of rapid changes in contour, such as flat planes and those having smooth surface finishes. Additionally, coatings such as FEP Teflon are useful in reducing adhesion.

Other embodiments of the invention utilize heat exchangers submerged in either the water based liquid or in "slush," depending on the previous operating history of the system. As the heat exchanger is cooled, "slush" forms and accumulates on the surface of the heat exchanger. As the size and weight of the accumulated "slush" increases, the accumulated "slush" interacts with either the water based liquid or "slush" due to the force of buoyancy causing at least a portion of the accumulated "slush" to release from the heat exchanger and mix with the water based liquid or previously harvested "slush." The "slush" is collected and stored for use in cooling systems.

The "no penalty" defrost cycle operates similarly to the "self release" cycle, except that heat is recovered from the refrigeration cycle and used to aid in releasing (harvesting) the accumulated "slush" from the heat exchanger. Recovery of heat from the refrigeration cycle requires a plurality of heat exchangers, with refrigerant being diverted from the high pressure receiver to the output of one or more selected heat exchangers to aid in release of "slush" accumulated thereon.

Experience has shown that the area of the heat exchanger covered by a particular accumulation of "slush" before release occurs varies widely. However, the system can be operated continuously using the "self release" cycle without requiring either added heat or mechanical means to remove the accumulated "slush" from the heat exchanger surfaces. Similarly, the "no penalty" defrost cycle can be operated continuously using heat recovered from the refrigeration cycle to harvest "slush."

EVALUATION OF SELF RELEASE TECHNIQUE

The system and technique for making "slush" which is the subject of this patent application includes two basic embodiments. Each embodiment utilizes a liquid comprising a water-electrolyte and/or water non-electrolyte solution or mixture in heat exchange relationship with a heat exchanger to form "slush" consisting of a mixture of the liquid and solids. The "slush" is accumulated on the heat exchanger and is harvested and mixed with an additional quantity of the liquid or with quantities of "slush" previous harvested.

As an aid in evaluating these techniques, an overall efficiency and cost comparisons were done by David E. Knebel of Knebel and Associates. From this study, based on a two hundred ton installed capacity, the following costs per ton were calculated.

Hot Gas Defrost (Prior Art): $1,091.00

Self Release (Preferred Embodiment): $ 783.00
No Penalty Defrost (Second Embodiment): $ 952.00

This same study also estimated that for a usage of 400,000 annual tons-hours as a base, the following savings per year in the total operating cost would result:

Self Release (Preferred Embodiment): $8400.00
No-Penalty Defrost (Second Embodiment): $4200.00

From the above analysis it is obvious that the above described "slush" ice making cycles offer the potential for reducing installation cost and the electrical energy usage requirements, while the ice storage system aids in reducing peak utility loads and annual operating cost.

DESCRIPTION OF THE DRAWINGS

FIG. 3 is a drawing illustrating a second alternate apparatus operable to implement the "self release" cycle for making "slush."

FIG. 4 is a drawing illustrating an air conditioning system utilizing "slush" as the coolant.

DETAILED DESCRIPTION

Figure 1:
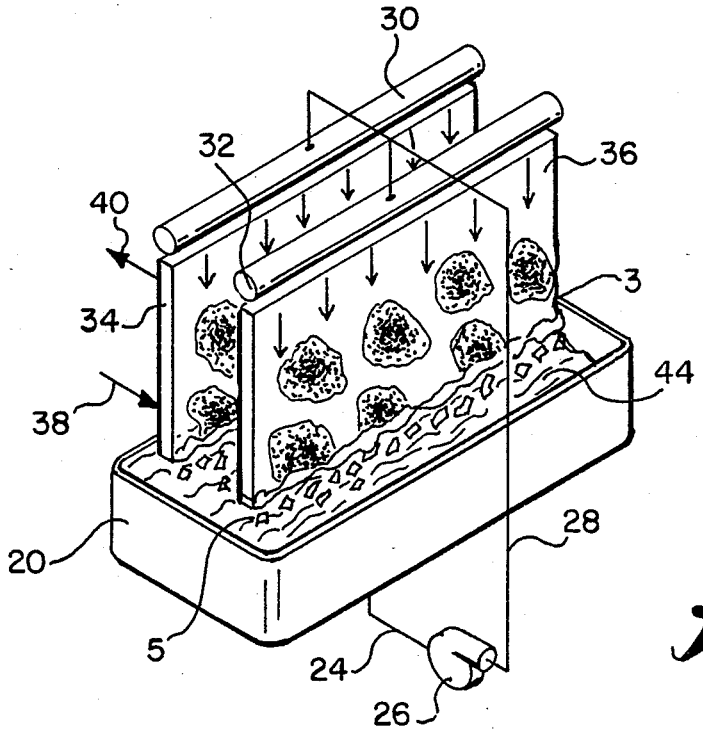
FIG. 1 is a drawing illustrating apparatus operable to implement the "self release" cycle for making "slush."

FIG. 1 is a drawing illustrating apparatus operable to implement the "self release" cycle for making "slush." This apparatus comprises the preferred embodiment of the invention.

In this embodiment, the "slush," is harvested and collected in a tank 20. The contents of the tank 20 is either "slush" or the water based liquid, depending on the prior operating history of the system. Liquid is separated from the contents of tank 20, if necessary using any convenient technique, and directed through a conduit 24 by a pump 26. The output of the pump 26 is in turn directed by conduit 28 to distributors, 30 and 32. The volume of the tank 20 is selected to provide the desired thermal storage capacity. In the preferred embodiment of the invention, the liquid is a mixture of water and electrolytes and/or non-electrolytes, as previously discussed. Other liquids may be usable.

Liquid from the distributors 30 and 32 is directed to flow down at least one substantially vertical (downwardly extending) surface of heat exchanger members, 34 and 36, as generally indicated by arrows on the surfaces of these members. Cold refrigerant flows through each of these heat exchanger members, 34 and 35, entering by way of input conduit 38 and exiting by conduit 40.

The temperature of the refrigerant is selected such that as the water based liquid flows down the surfaces of the heat exchanger members, 34 and 36, portions of the liquid solidifies to form ice crystals which accumulate thereon as a "slush," typically illustrated at reference numeral 35. This "slush" is soft (as compared to a solid formed from freezing substantially pure water) and consists of a mixture of the water based liquid and ice crystals. Low adhesion forces (as compared to substantially crystalline ice) are produced between the accumulated "slush" and the smooth vertical surfaces of the heat exchangers, 34 and 35. Low cohesion forces cause the "slush" to be soft, as described above.

For purposes of this patent application, the term "adhere" is used as a generic term for all forces tending to cause a mass consisting of a mixture of solids and a liquid to be attracted to a surface.

Also, for purposes of this patent application, the term "cohere" is used as a generic term for all forces tending to cause ice crystals and a liquid to be attracted to each other.

The accumulated "slush" interacts with the water based liquid and the forces of gravity. The magnitude of these interactions increases as the accumulated "slush" 35 increases in size and/or thickness. As these interactions become sufficient to overcome the adhesion and/or cohesion forces, portions or all of the accumulated "slush" releases from the heat exchanger members, 34 and 36, and mixes the contents 44 of the tank 20. The contents of the tank 20 may be "slush" or the water based liquid, depending on the operating history of the system.

In order to assure operation of the system and "slush" ice making cycle as described above, it is helpful to select the surfaces for the heat exchanger members, 34 and 36, and the water based liquid such that the adhesion and/or cohesion forces are reduced to the lowest practical level. That is to say, it is currently believed that as the adhesion and/or cohesion forces are decreased, the operation of the cycle improves. A complete absence of adhesion and cohesion forces is desirable. However, this goal has not been attained and may not be attainable using current technology.

However, significant reductions in adhesion and cohesion are accomplished in accordance with the present invention by utilizing a water based liquid that includes electrolytes and/or non-electrolytes, as well as heat exchanger members, 34 and 36, having surfaces which reduce adhesion forces. Liquids comprising a mixture of electrolytes and/or non-electrolytes, such as a 30/70 calcium acetate-magnesium acetate mixture or ethylene gylcol, respectively, and water are suitable for use in all embodiments of the invention. Such liquids have previously been referred to as "water based." Similarly the surfaces of the heat exchange members, 34 and 36, may be coated with material such as Teflon or its derivatives to reduce adhesion forces.

Figure 2:
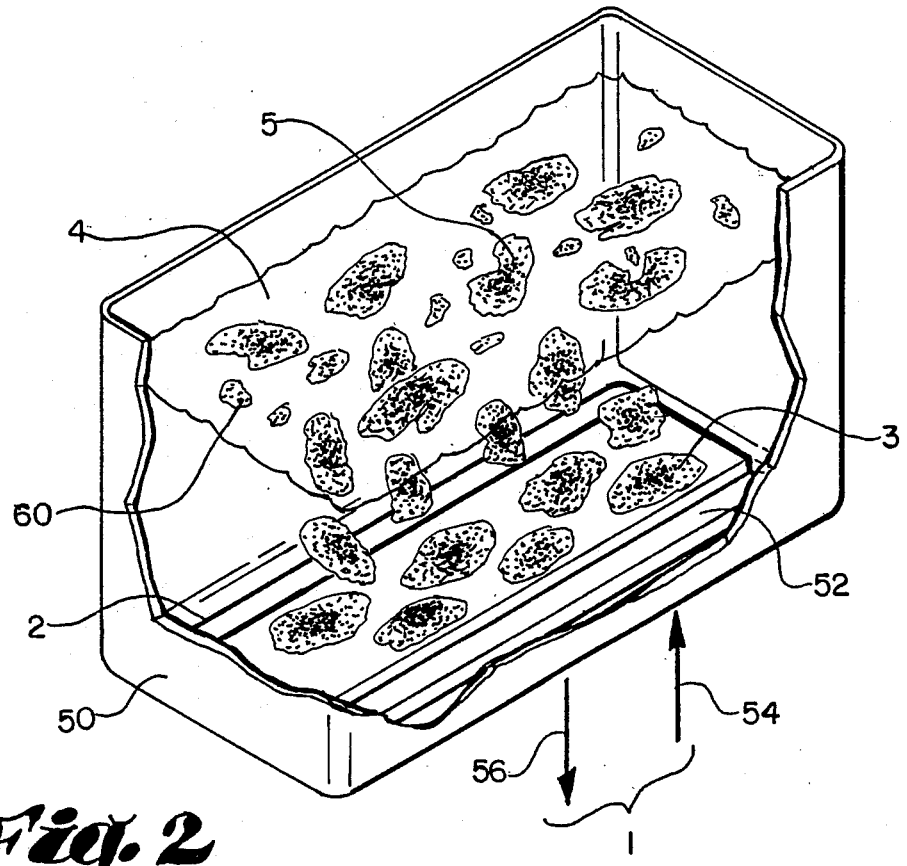
FIG. 2 is a drawing illustrating alternate apparatus operable to implement the "self release" cycle for making "slush."

FIG. 2 illustrates alternate apparatus operable to implement the "self release" cycle for making "slush." The "slush" 49 is contained in a tank 50. Disposed along the bottom surface of the tank 50 is a heat exchanger member 52, which is cooled by refrigerant entering via conduit 54 and exiting via conduit 56. The temperature of the refrigerant is selected such that "slush", typically illustrated at reference numeral 58 forms on and adheres to the upper surface of the heat exchanger member 52 as the water based liquid contained in tank 50 is cooled. The accumulated "slush" interacts with a force due to buoyancy. As the mass of the accumulated "slush" increases, this force becomes sufficient to separate all or part of the accumulated "slush" 58 from the heat exchanger member 52. The separated "slush" floats upward, as typically illustrated at reference numerals 60 and 65 and mixes with the contents of the tank 50. As with previous embodiments, the contents of the tank 50 may be either "slush" or the water based liquid, depending on the prior operational history of the system.

As with the embodiment illustrated in FIG. 1, it is necessary to select the water based liquid as well as the characteristics of the heat exchanger member 52 such that the force of buoyancy interacts with the accumulated "slush", and become sufficient to detach a portion or all of the accumulated "slush" from the heat exchanger 52. This result can be achieved by using suitable electrolytes and/or non-electrolytes in the water based liquid. Heat exchangers having low cohesion surfaces further aid in releasing the accumulated "slush". The electrolytes and heat exchanger surfaces described above are also usable in this apparatus.

FIG. 3 illustrates second alternate apparatus operable to implement the "self release" cycle for making "slush." The illustrated apparatus utilizes a two sided heat exchanger 70, positioned near the bottom of a tank 73. The tank 73 contains either the water based liquid or "slush," depending on the prior operating history of the system.

Refrigerant enters the heat exchanger member 70 through conduit 72 and exits by way of conduit 74. The temperature of the refrigerant is selected such that "slush" forms and accumulates on the outer surfaces of the heat exchange member 70, as typically illustrated at Reference Numeral 76 and 78.

As with the previous embodiments of the invention, the characteristics of the water based liquid, the characteristics of the "slush" and the surfaces of the heat exchanger element 70 are selected such that the force of buoyancy is sufficient to separate at least a portion of the accumulated "slush" from the surfaces of the heat exchanger 70, causing the separated "slush" to float toward the surface. The separated "slush" mixes with the contents of the tank 73. Typical accumulations of "slush" which have separated from the heat exchanger 70 are illustrated at reference numeral 75.

A primary use of the "slush" ice making system, which is the subject of this invention, is to provide heat storage for use in air-conditioning and other cooling systems.

Use of the improved "slush" making cycle as applied to a typical air conditioning system is illustrated in FIG. 4. In this embodiment cold refrigerant is supplied to heat exchanger 90 by a compressor 94 via a condenser 95, high pressure receiver 97 and a conduit 92. Refrigerant is returned to the compressor 94 by a conduit 96. This is a typical prior art refrigeration cycle.

Liquid is circulated from a storage tank 98 and caused to flow over the heat exchanger 90 by a distributor 100 and a pump 102. Primary coolant in the form of "slush" is circulated through the air conditioning system as the primary coolant in the form of "slush" or cold liquid by a pump 104 and returned to the tank 98 via a conduit 106. It should also be noted that the "no penalty" cycle for making "slush" is also usable in this embodiment. A plurality of heat exchangers may also be used. Other conventional refrigeration devices may be incorporated into the system to produce and control the flow of the refrigerant.

Figure 5:
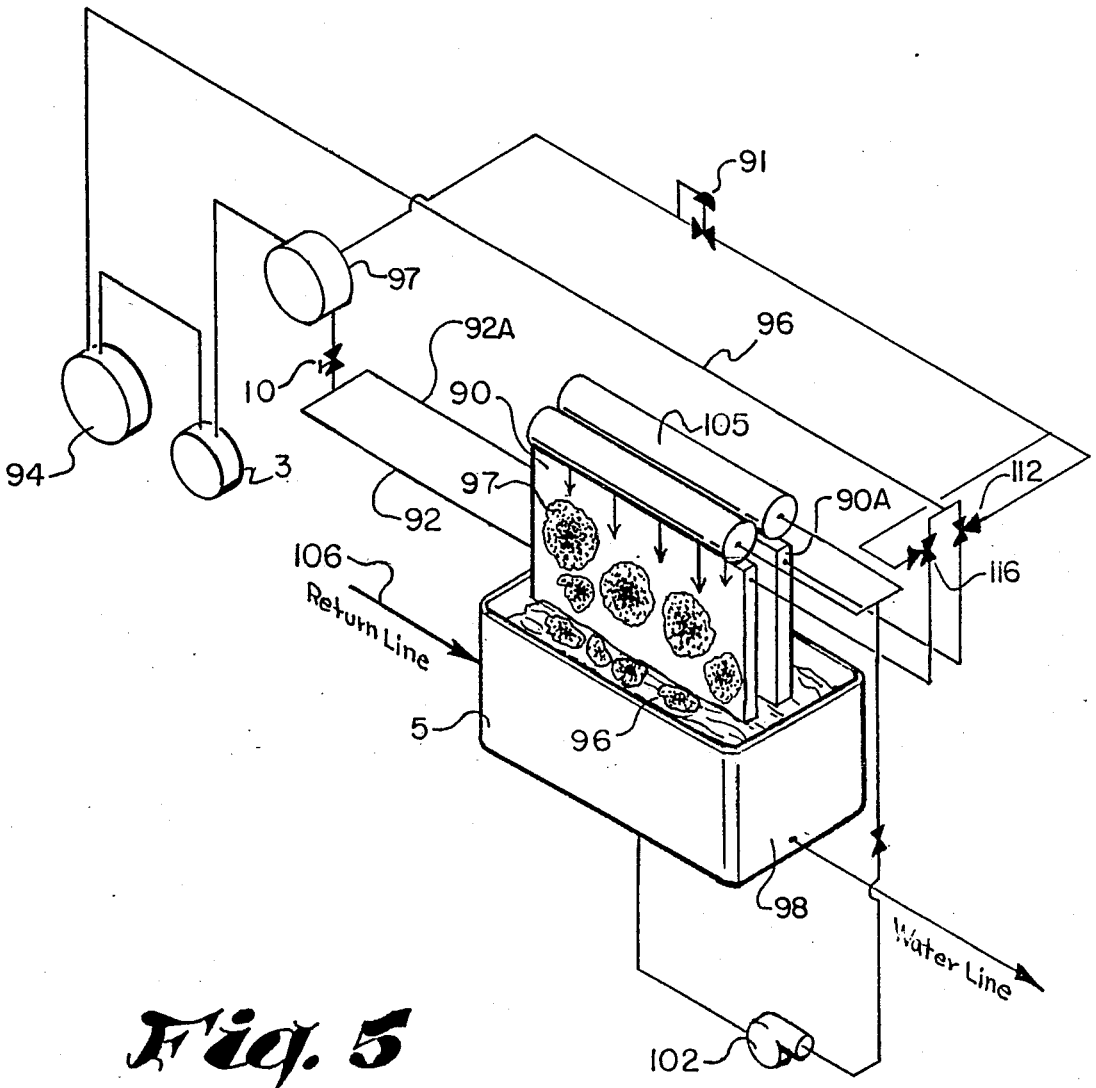
FIG. 5 is a drawing illustrating the "no penalty" defrost "slush" ice making cycle.

An embodiment of an air conditioning system utilizing the "no penalty" defrost cycle is illustrated in FIG. 5. This embodiment is similar to the embodiment illustrated in FIG. 4. To emphasize this similarity, the same reference numbers are used in these figures to identify similar components.

FIG. 5 illustrates apparatus operable to implement the "no penalty" harvesting technique. Refrigerant is supplied to the heat exchangers, 90 and 90A, by a compressor 94 via a condenser 95, a high pressure receiver 97 and conduits, 92 and 92A. This is a typical prior art refrigeration cycle.

This embodiment includes additional valves and conduits which permit refrigerant to be periodically directed through the heat exchangers to assure that all ice accumulations are periodically cleaned from these surfaces. For example, two valves, 112 and 116, permit the refrigerant flow to be selectively directed to the outputs of heat exchangers, 90 and 90A. For example, valve 112 permits the refrigerant from one of the heat exchangers to be directed to the input of the other heat exchanger 90. Additional conventional pressure regulating apparatus 91 are required.

The refrigerant into the output side of the heat exchangers, 90 and 90A, is sufficiently warm to increase the temperature of the heat exchanger through which it flows. Energy stored in the refrigerant at the output of the heat exchanger is recovered using this technique and used to assure that all of the accumulated "slush," typically illustrated at reference numeral 97 is periodically harvested. Energy used in this harvesting technique is normally dissipated without any useful contribution to the "slush" making cycle. Thus, the "no penalty" defrost cycle does not require additional energy input to implement the defrost portion of the cycle. This is the "no penalty" harvesting cycle previously discussed.

The function of the compressor 94, the condenser 95, and the other components associated therewith is to produce the desired flow of refrigerant to cool the heat exchangers to produce the desired quantity of "slush". Other conventional refrigeration cycles and components may be used or incorporated into the illustrated embodiments of the invention to produce the desired cooling of the heat exchangers, 90 and 90A. Other changes which are within the scope of the invention are also possible.

We claim:

1. Apparatus operable to produce "slush", said apparatus including at least one heat exchanger having at least one downwardly extending surface selectively cooled by a refrigerant selectively flowing through said heat exchanger and selected liquid means directed along a downward path and in heat exchange relationship with said downwardly extending surface to selectively cool said selected liquid means, said selected liquid being such that when slush consisting of a mixture of said selected liquid means and solids forms and selectively accumulates on said downwardly extending surface, forces resulting from gravity and the interactions with said selected liquid means are sufficient to overcome the adhesion forces between at least a portion of said slush and said downward extending surface causing at least a portion of said slush to separate from said downward extending surface.

2. Apparatus in accordance with claim 1 further including a coating affixed to at least one downward extending surface of said heat exchanger, said coating being selected to reduce adhesion between said coating and said slush.

3. Apparatus in accordance with claim 1 further including a plurality of heat exchange surfaces and means for periodically recirculating refrigerant from the output of said heat exchanger to selectively increase the temperature of at least a selected one of said downwardly extending surfaces of said heat exchanger to release at least a portion of said slush.

4. Apparatus in accordance with claim 3 wherein said liquid comprises an electrolyte.

5. Apparatus in accordance with claim 5 wherein said electrolyte comprises three parts calcium acetate and seven parts magnesium acetate.

6. Apparatus operable to produce a mixture of solids and a selected liquid means, said apparatus including at least one downwardly extending heat exchange surface and selected liquid means in heat exchange relationship therewith to form a mass consisting of a mixture of said selected liquid means and said solids, said selected liquid means being selected to produce a mass having an interface with and adhering to said heat exchange surface, said selected liquid being such that said mass selectively increases as a function of time and selectively interacts with said selected liquid means and with the force of gravity to increase the stress along said interface as said mass increases to release at least a portion of said mass from said heat exchange surface.

7. Apparatus in accordance with claim 6 wherein said mass accumulates on said heat exchanger surface as a sheet of indefinite area and having an average thickness of less than one half inch.

8. Apparatus in accordance with claim 6 wherein said mass is grown from ice crystals formed in said liquid.

9. Apparatus in accordance with claim 6 further including a layer affixed to said heat exchange surface said layer being selected to reduce adhesion forces between said heat exchanger surface and said mass.

10. A method of producing "slush", said method comprising the steps of:

(a) passing a refrigerant through a heat exchanger having at least one downwardly extending surface;

(b) directing a selected liquid to contact and flow downward along said downward extending surface, said liquid being selected such that solids form in said liquid and accumulates of said downward extending surface until the forces resulting from gravity and interaction with said liquid are sufficient to overcome the adhesion forces between at least a portion of said slush and said downward extending surface causing at least a portion of said slush to separate from said downward extending surface causing said slush to form in said liquid.

* * * * *